US007900401B2

(12) United States Patent
Pedretti

(10) Patent No.: US 7,900,401 B2
(45) Date of Patent: Mar. 8, 2011

(54) PNEUMATIC TWO-DIMENSIONAL STRUCTURE

(75) Inventor: Mauro Pedretti, Biasca (CH)

(73) Assignee: Airlight Limited (AG), Biasca (CH)

( * ) Notice: Subject to any disclaimer, the term of this patent is extended or adjusted under 35 U.S.C. 154(b) by 1189 days.

(21) Appl. No.: 10/577,583

(22) PCT Filed: Nov. 1, 2004

(86) PCT No.: PCT/CH2004/000656

§ 371 (c)(1),
(2), (4) Date: May 19, 2006

(87) PCT Pub. No.: WO2005/042880

PCT Pub. Date: May 12, 2005

(65) Prior Publication Data

US 2007/0094937 A1 May 3, 2007

(30) Foreign Application Priority Data

Nov. 4, 2003 (CH) ..... 1886/03
Jun. 4, 2004 (CH) ..... 0965/04

(51) Int. Cl.
*E04B 1/34* (2006.01)
*E04C 3/02* (2006.01)

(52) U.S. Cl. ..... 52/2.11; 52/2.13

(58) Field of Classification Search ..... 52/2.22, 52/2.23, 2.11, 2.13
See application file for complete search history.

(56) References Cited

U.S. PATENT DOCUMENTS 2,636,457 A * 4/1953 Rohlfs et al. ..... 52/2.19
3,123,085 A * 3/1964 Demataeu ..... 52/2.25
3,145,853 A 8/1964 Langenberg
3,388,509 A * 6/1968 Mora ..... 52/2.15
3,894,307 A * 7/1975 Delamare ..... 14/27
3,987,736 A * 10/1976 Miller ..... 410/119
4,004,380 A * 1/1977 Kwake ..... 52/2.18
4,676,032 A 6/1987 Jutras
6,543,730 B2 * 4/2003 Pedretti ..... 248/52
2006/0033335 A1 * 2/2006 Pedretti ..... 285/412
2006/0192048 A1 * 8/2006 Pedretti et al. ..... 244/24
2006/0273233 A1 * 12/2006 Pedretti et al. ..... 248/560
2008/0168981 A1 * 7/2008 Cummings et al. ..... 126/600
2009/0282746 A1 * 11/2009 Luchsinger ..... 52/2.11
2010/0011674 A1 * 1/2010 Crettol et al. ..... 52/2.11

FOREIGN PATENT DOCUMENTS

DE 101 42 108 5/2003
JP 6-317044 * 11/1994
WO WO-01/73245 10/2001
WO 2005/007991 A1 * 1/2005
WO 2007/071100 A1 * 6/2007

(56)

**References Cited* cited by examiner**
Robert J Canfield

(74) *Attorney, Agent, or Firm* — Winstead PC

(57) ABSTRACT

The invention relates to a pneumatic plate element (1) consisting of a hollow body (3) that can be impinged upon with a pressure medium having overpressure p. Said hollow body is located between two pressure/tension elements (2) that are connected to one another by their ends and is made of a flexible membrane (9). When transversal load is exerted on the plate element (1) placed on two supports (17) with load force F, the top pressure/tension element (2, 7) is subjected to pressure and the bottom pressure/tension element (2, 8) is subjected to tension. Prestressed tension elements (4) placed at a distance a traverse in channels the hollow body (3) between the pressure/tension elements (2, 8). The tension elements (4) are prestressed by the hollow body (3) separating the tension elements (2). The connections (6) operate as fictitious fixed intermediate supports and stabilize the pressure/tension element (2, 7) submitted to pressure in order to prevent buckling. Two-dimensional plate elements (1) can be particularly used for building roofs of lightweight constructions.

38 Claims, 9 Drawing Sheets

PNEUMATIC TWO-DIMENSIONAL STRUCTURE

Figure 1A:
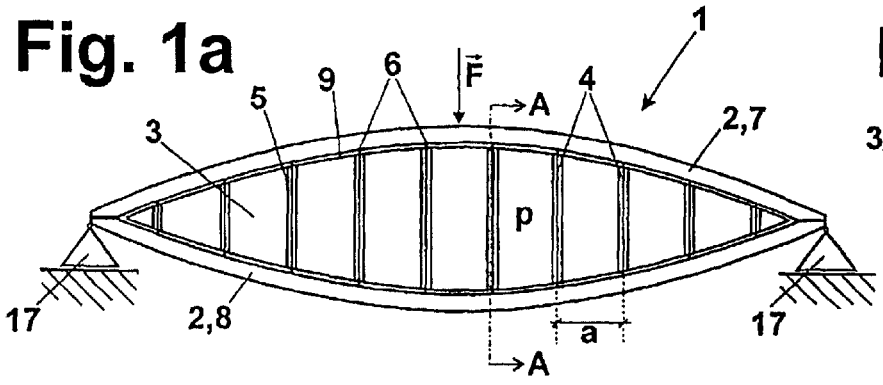

The present invention relates to a pneumatic plate element.

Pneumatic components or supports, consisting of an inflatable hollow body and separate elements for absorbing compression and tensile forces, are known. The most closely related description of the art is represented in WO 01/73245 (D1).

In D1, the hollow body that is subjected to pressure loading serves primarily to stabilize the pressure element and to prevent it from buckling. To this end, the pressure element is attached non-positively to the membrane of the hollow body over some or all of its length.

In addition, the height of the support elements is defined by the hollow body, and the tensile and compressive elements are also located separately from each other. The design disclosed in document D1 enables very light but rigid and pneumatic structures to be produced that are capable of bearing considerable loads. However, the pneumatic element described in the preceding has a number of drawbacks. The tensile forces in the membrane of the hollow body may exert high stresses on the area of the attachment between the membrane and the pressure element with regard to tear strength. Moreover, the structural design of this attachment is very complex and therefore very expensive. The hollow body cross sections of the components that are possible are essentially limited to circles. The support element disclosed in D1 is essentially a one-dimensional support structure. For roof structures covering large surface areas, that is to say essentially two-dimensional support structures, an extra roof membrane is required and must be stretched between or over support elements. The hollow body also has a large membrane surface area relative to the area it covers (the following formula applies for circular cross sections: circumference/diameter=pi, i.e. approx. 3.14 $m^2$ membrane per $m^2$ of covered area), which again leads to relatively high costs.

The object of the present invention is to provide a pneumatic support structure element that eliminates these disadvantages of the known constructions and which may be constructed as a large-area, two-dimensional support structure.

Figure 2:
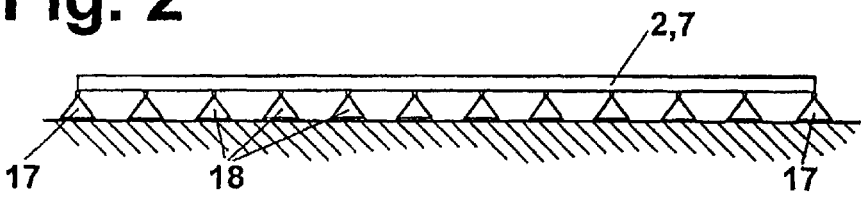
Figure 3:
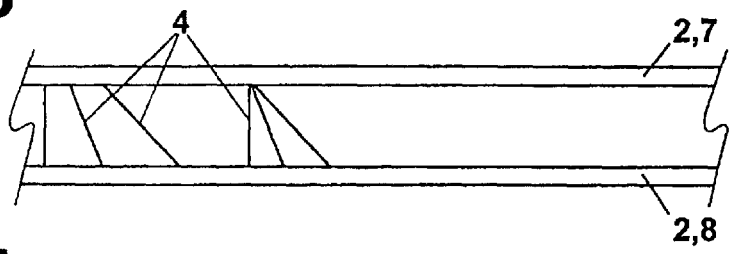
Figure 4:
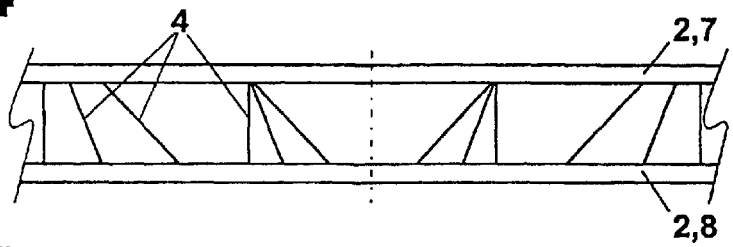
Figure 5:
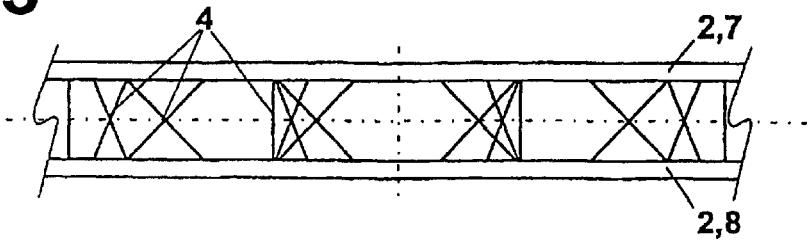
Figure 6:
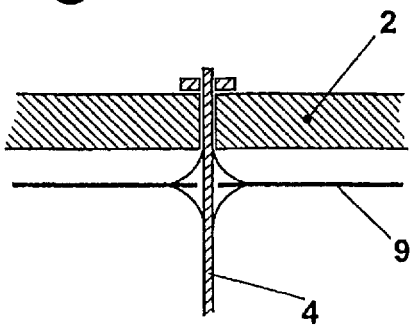
Figure 7:
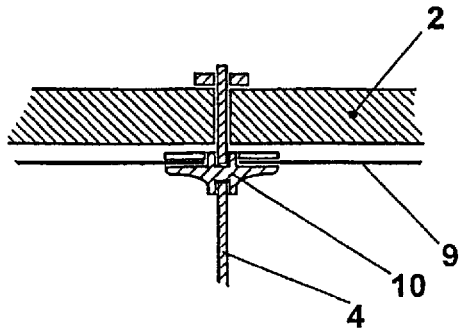
Figure 8:
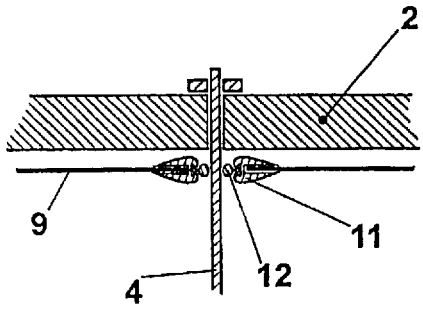
Figure 9:
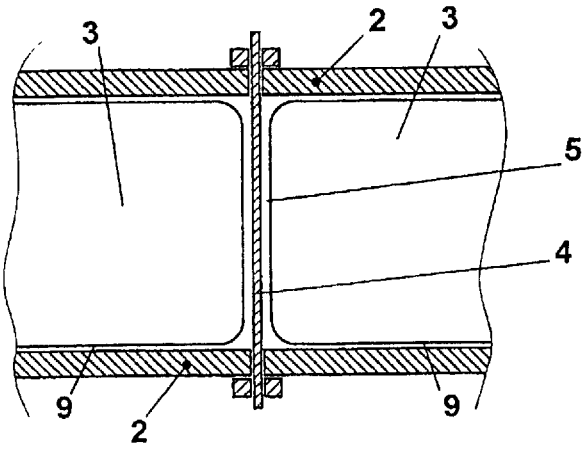
Figure 10:
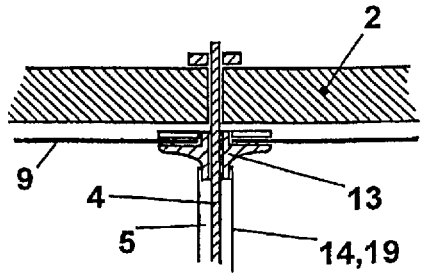
Figure 11:
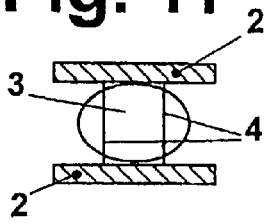
Figure 12:
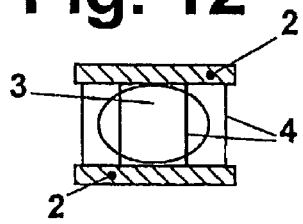
Figure 13:
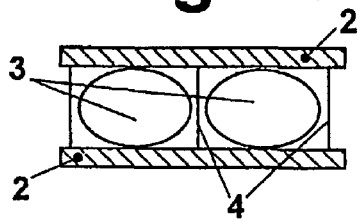
Figure 17:
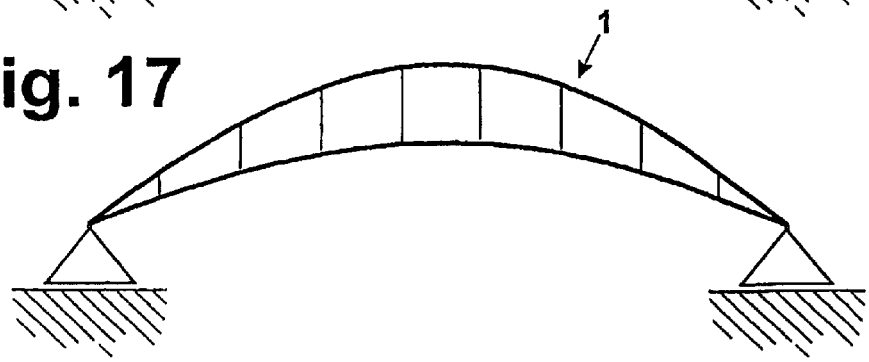
Figure 18:
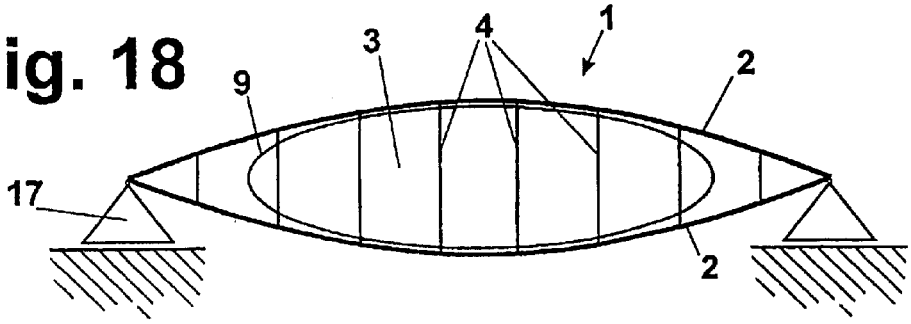
Figure 19:
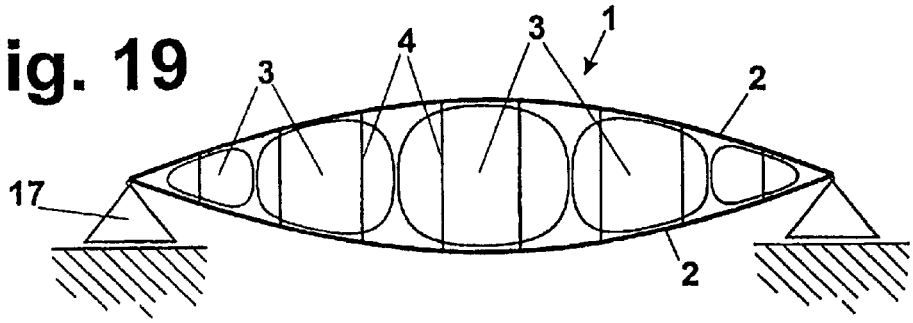
Figure 20:
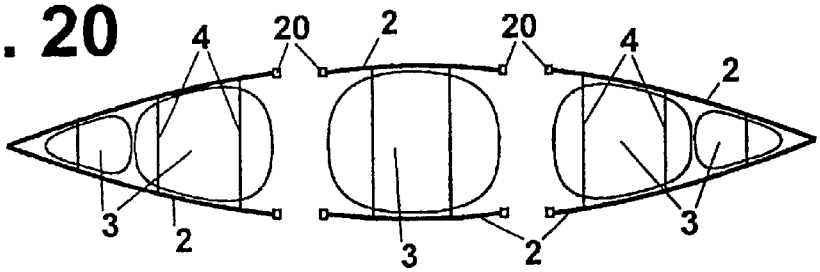
Figure 21:
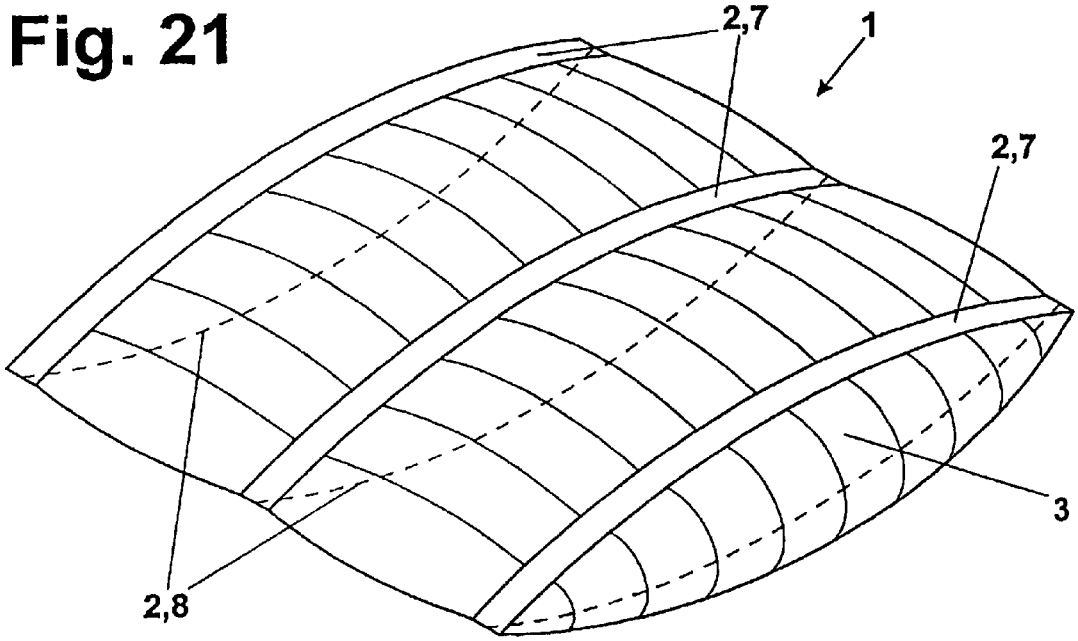
Figure 22:
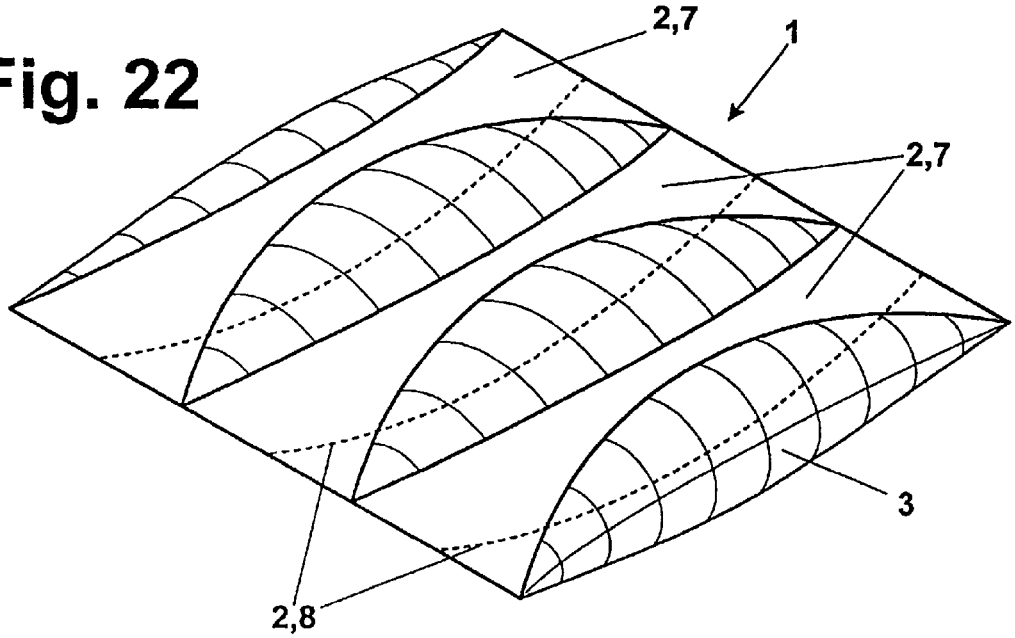
Figure 23:
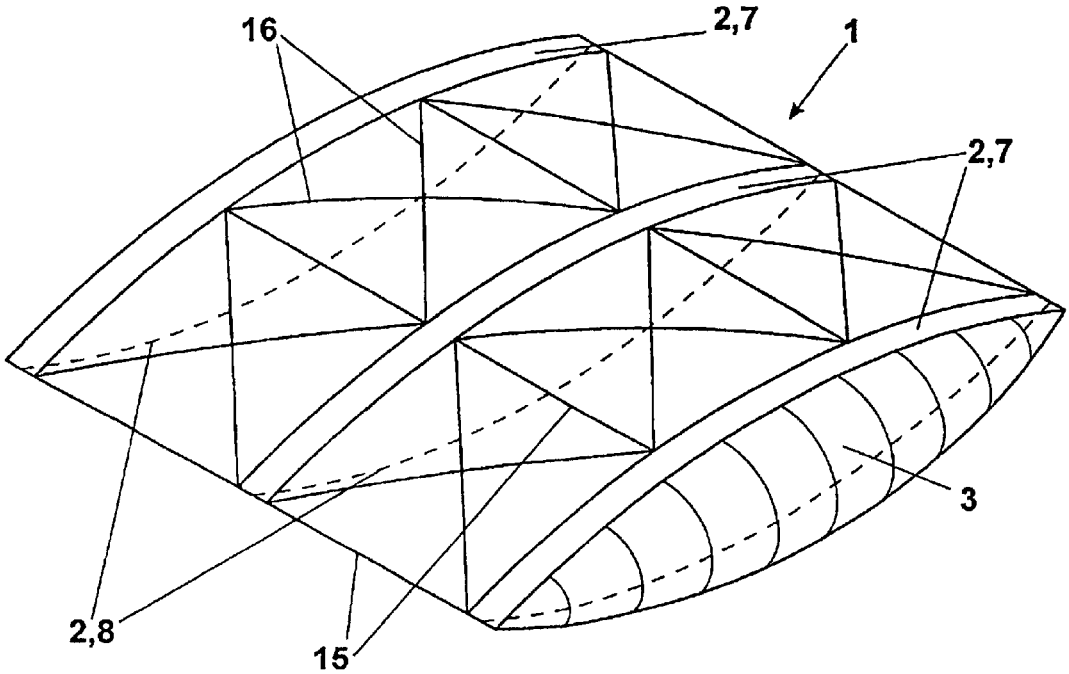
Figure 24:
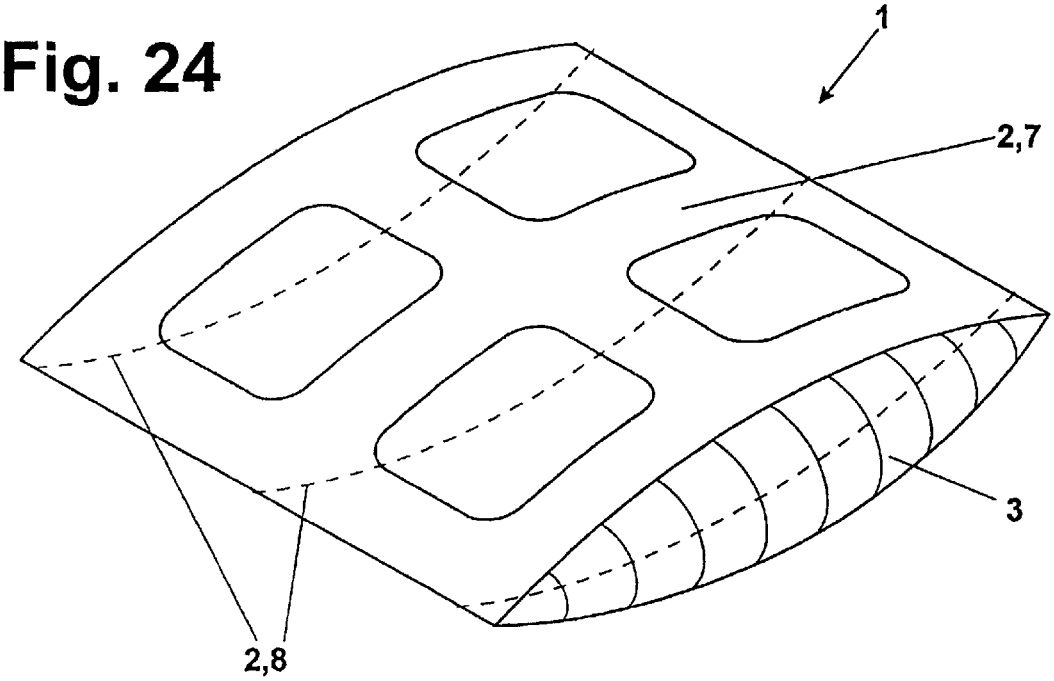
Figure 25:
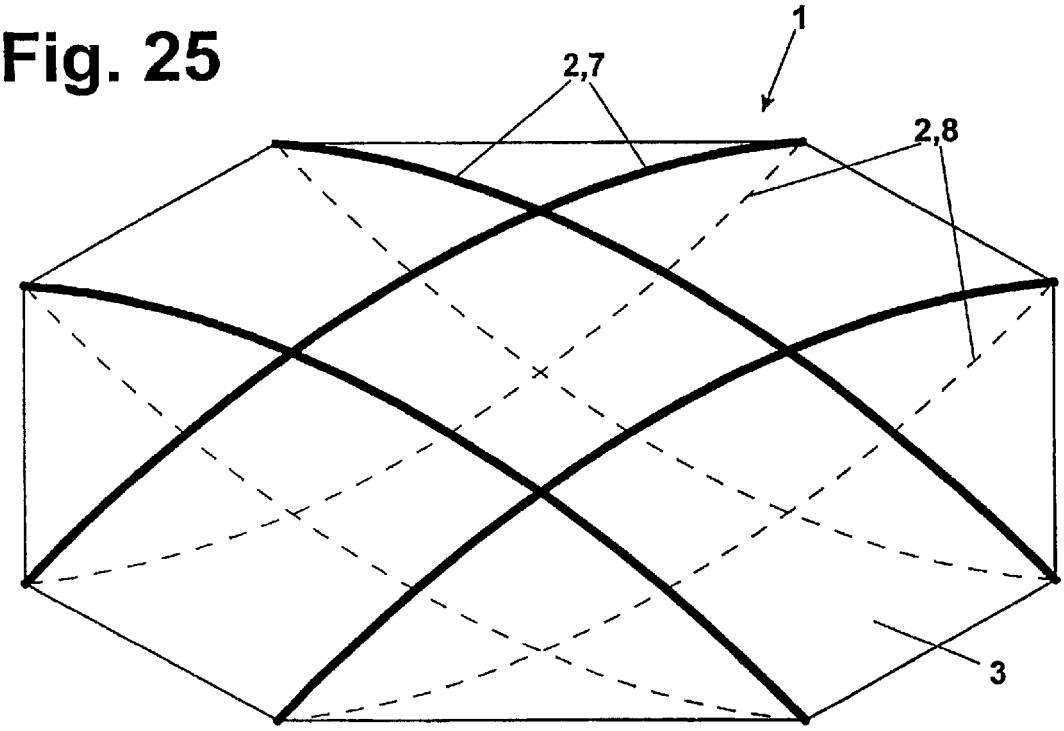
Figure 26:
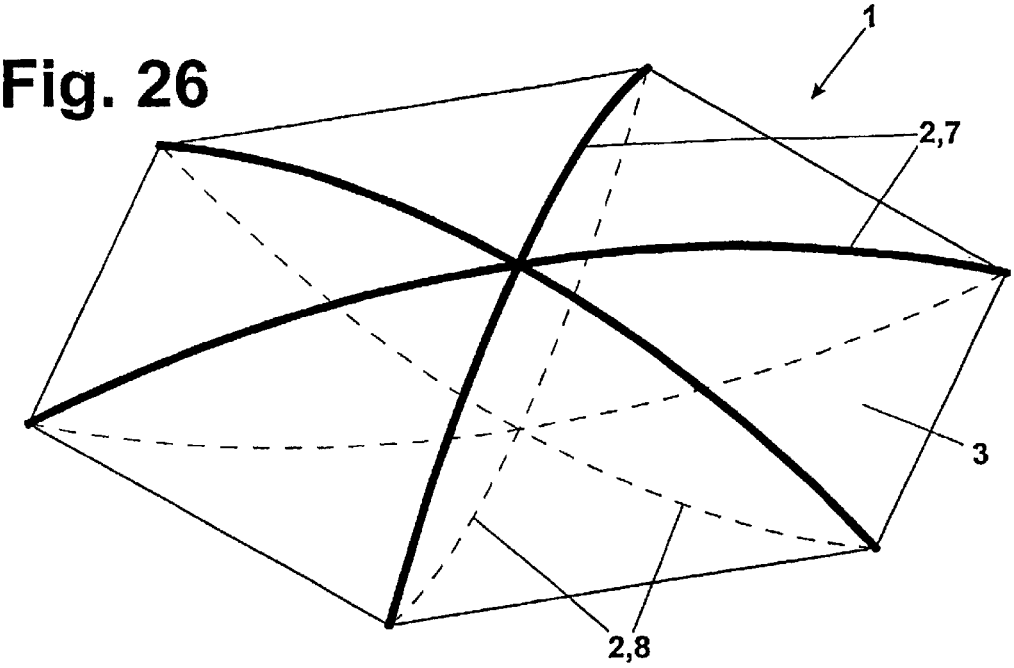
Figure 27:
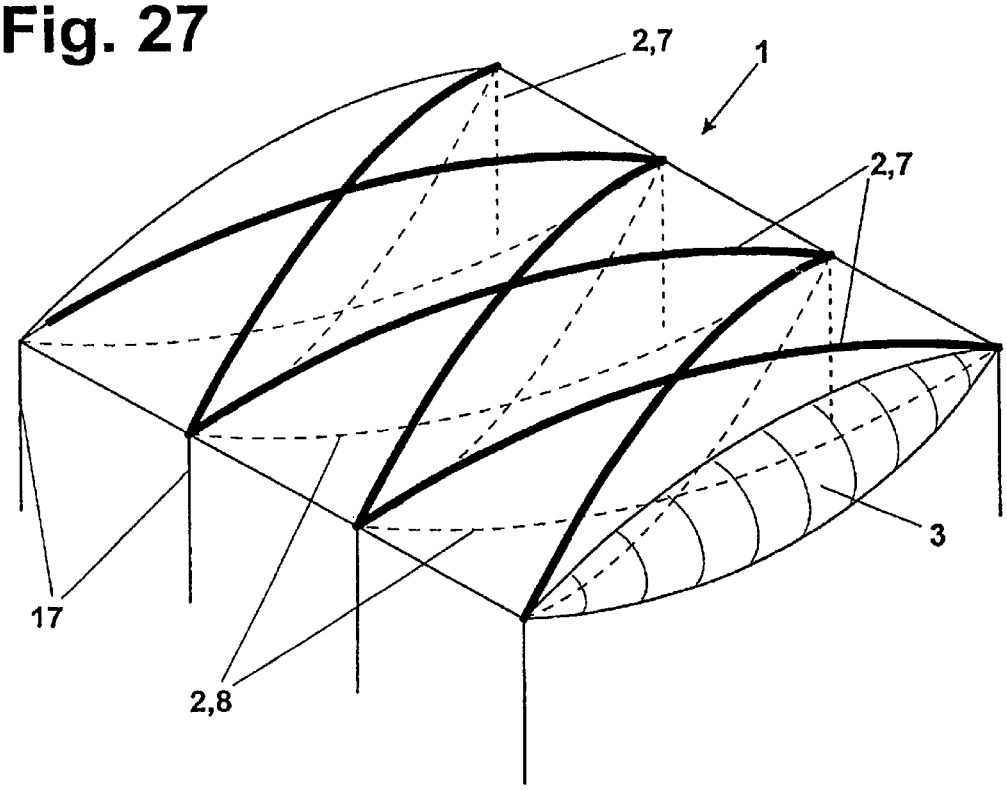
Figure 28:
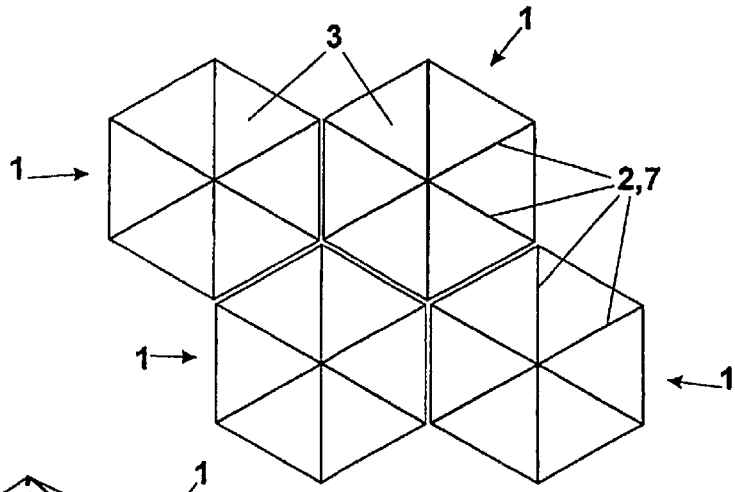
Figure 29:
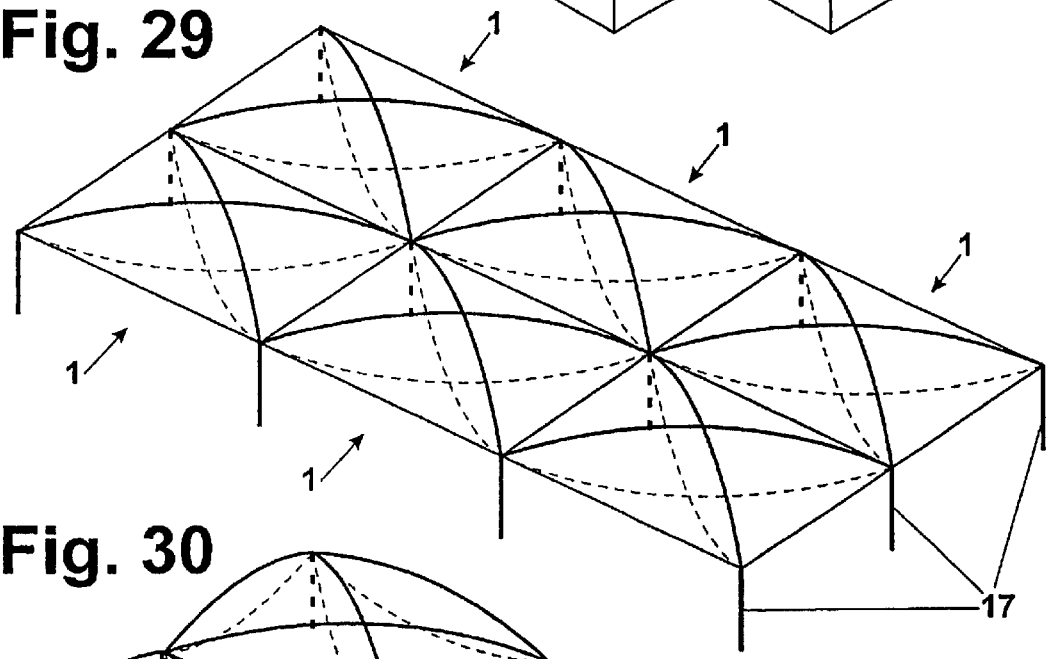
Figure 30:
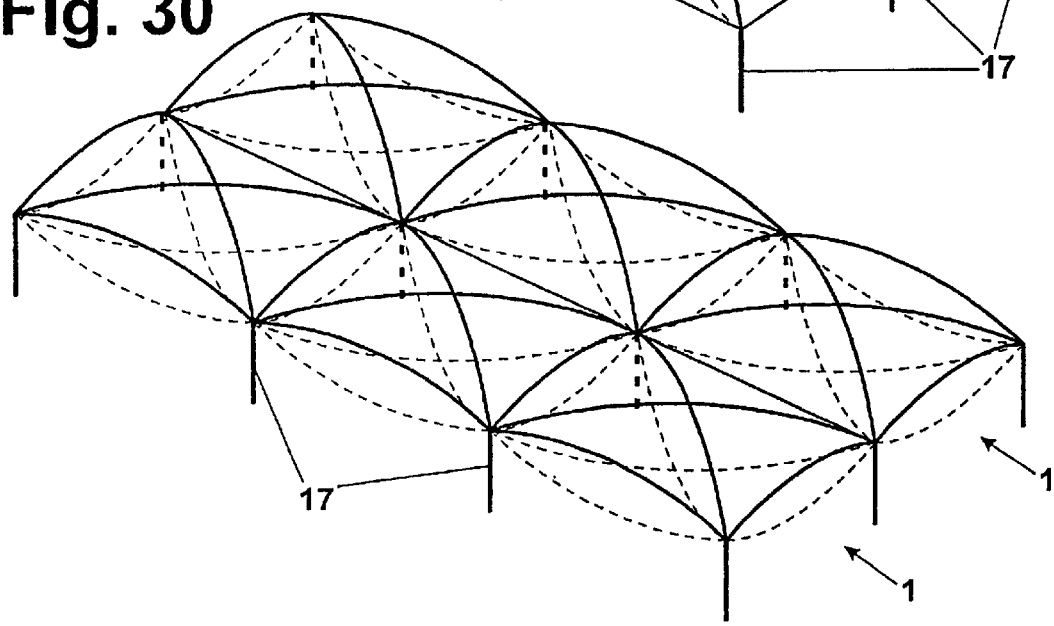
Figure 31A:
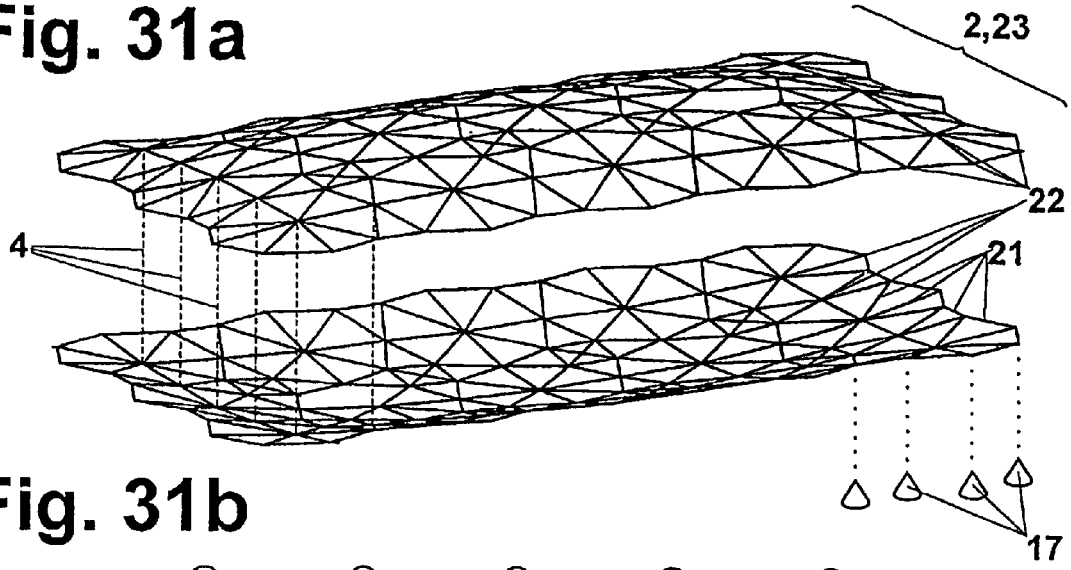
Figure 32:
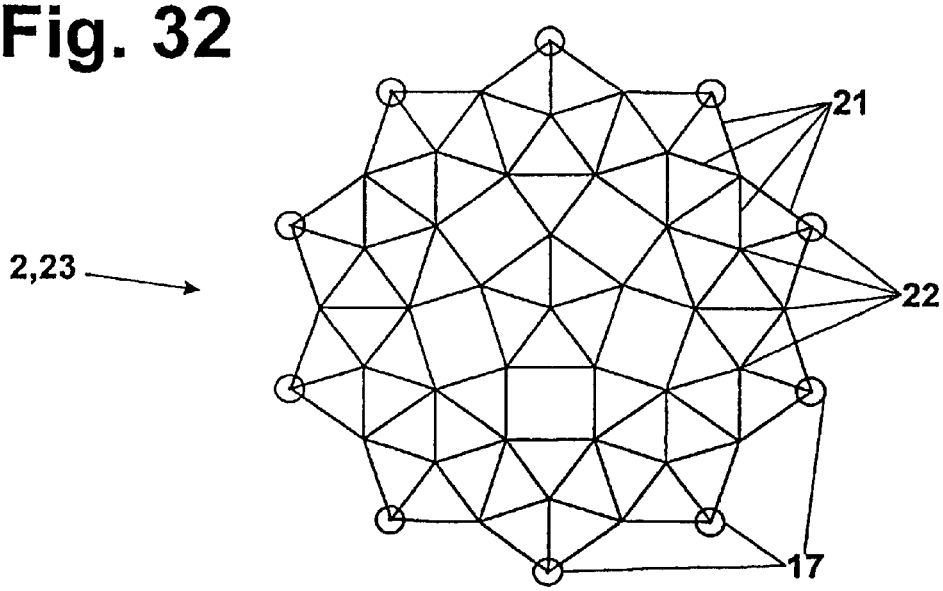

The object of the invention will be explained in greater detail with reference to the accompanying drawing. In the drawing:

FIGS. 1*a, b* shows a longitudinal and cross section of a first embodiment of a pneumatic plate, FIG. 2 illustrates the static principle with reference to a beam in side view, FIGS. 3-5 show various arrangement options for the prestressed tension elements in side view, FIGS. 6-8 show a longitudinal section view of various methods of passing the pre-stressed tension elements through the membrane of the hollow body in gas-impermeable manner, FIGS. 9, 10 show longitudinal section views of two embodiments of a method for passing the prestressed tension elements through the hollow body, FIGS. 11-13 show cross section views of various arrangement options for the prestressed tension elements, FIGS. 14-17 show longitudinal section views of plate elements in various shape variants, FIG. 18 shows a longitudinal section view of an embodiment of a plate element whose shape differs from that of the hollow body, FIG. 19 shows a longitudinal section view of an embodiment of a plate element having several hollow bodies aligned transversely to the direction of the compression/tension elements, FIG. 20 shows a longitudinal section view of an embodiment of a separable plate element in the separated condition, FIG. 21 shows a longitudinal section view of an embodiment of a plate element with in the separated condition, FIG. 22 shows an isometric view of an embodiment with pressure plates with variable cross section, FIG. 23 shows an isometric view of an embodiment with transverse reinforcements of the pressure elements, FIG. 24 shows an isometric view of an embodiment with a single pressure plate with large cutouts, FIG. 25 shows an isometric view of an embodiment of a plate element with compression/tension elements arranged in two directions, FIG. 26 shows an isometric view of an embodiment of a plate element with a polygonal arrangement of the compression/tension elements, FIG. 27 shows an isometric view of an embodiment of a roof consisting of a plate element, FIG. 28 shows an aerial view of several polygonal plate elements, FIG. 29 shows an isometric view of a combination of several rectangular plate elements, FIG. 30 shows a schematic isometric view of two rectangular plate elements, FIGS. 31*a, b* shows schematic, exploded isometric and plan view of an embodiment of a plate element with compression/tension lattices, FIG. 32 shows a plan view of a second embodiment of a plate element with compression/tension lattices.

Figure 1B:
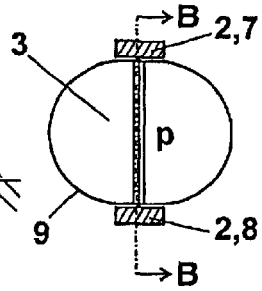

FIGS. 1*a, b* show a first embodiment of a pneumatic plate element 1. FIG. 1*a* shows pneumatic plate element 1 in longitudinal section BB, FIG. 1*b* in cross section AA. Two compression/tension elements are attached non-positively to each other by their ends and enclose a hollow body 3, which is made from a flexible membrane 9 and is capable of absorbing pressure. Because of the low tensile stresses exerted on it, membrane 9 may be made for example from highly transparent, very thin foils of partially fluorinated thermoplastic plastics (for example ETFE, ethylene-tetrafluoroethylene).

Compression/tension elements 2 are suitable for absorbing both tensile and compressive forces and may be made for example from wood or steel. The two compression/tension elements 2 are connected non-positively to each other at for example regular intervals a via tension elements 4 that serve purely to absorb tensile forces. These tension elements 4 pass through hollow body 3. They are situated for example in gas-impermeable channels 5 that traverse hollow body 3. Hollow body 3 is not attached to compression/tension elements 2. Pneumatic plate element 1 is essentially supported on a support 17 in the area of the non-positive attachment of compression/tension elements 2.

If hollow body 3 is subjected to pressure, compression/tension elements 2 are forced apart and tension elements 4 are prestressed. If plate element 1 is loaded transversely, compression forces are exerted on the compression/tension element 2 located above hollow body 3, and tensile forces are exerted on the compression/tension 2 element 2 that passes through hollow body 3. The compression/tension element 2 that is subjected to compression tends to buckle under load. A connector 6 between the compression/tension elements 2 and the prestressed tensile elements 4 acts as an intermediate support 18 for compression/tension element 2 and in static terms causes the compression/tension element 2 that is loaded with pressure to act as a compression strut or a pressure plate with rigid or elastic intermediate supports 18 according to the prestressing of tensile elements 4 and depending on the magnitude of transversely acting force F. The essentially equivalent situation in static terms is illustrated in FIG. 2 with the example of a beam that is supported at intervals on multiple rigid intermediate supports 18 between the two supports 17.

For purposes of simplicity, in the following text, single-sided load situations, for example due to gravitational forces F, will be assumed for pneumatic plate elements 1. Accordingly, the upper compression/tension elements 2 that are generally subjected to compression loads will be designated compression elements 7, and the lower compression/tension elements 2 that are generally subjected to tensile loads will be designated tension elements 8. In cases in which this one-sided load situation is never reversed, the compression/tension element 2 that is always subjected to tension may of course also be constructed as a pure tension element 8, which is and may be subjected exclusively to tensile loading. For example, a rope or cable may be used for this. In the case of roofs, however, wind drag may cause the weight of the roof construction to be overcompensated, and thus cause compression forces to be exerted on the lower compression/tension elements 2 as well. Fluctuating compressive or tensile loads on compression/tension elements 2 also arise in plate elements that are erected vertically, for example when they are used as walls.

While the prestressing force of vertical tensile element 4 is greater than the stabilising force that is required to prevent compression element 7 from buckling, connections 6 operate as fictitious fixed intermediate supports. Deflections only occur at point of connections 6 when the stabilising force required exceeds the prestressing force of prestressed tensile element 4. Overpressure p in hollow body 3, distance a between prestressed tensile elements 4 and the width and height of compression element 7 are selected for a defined load of plate element 1 such that the prestressing force is always significantly greater than the stabilising force required to prevent buckling. In this context, the smaller the distances a, the smaller the prestressing force from prestressed tensile elements 4 for stabilising compression element 7. As distances a increase, this stabilising prestressing force also becomes larger, but at the same time the unstabilised, unsupported length in compression element 7 also becomes larger, and this may cause buckling under even relatively small axial compression forces acting on compression element 7. The best distribution and number of prestressed tensile elements 4 with regard to stability and weight may be optimised arithmetically on a case by case basis.

FIGS. 3-5 show a number of different variants in the way tensile elements 4 may be tightened between compression/tension elements 2. Hollow body 3 is not shown in these figures. FIG. 3 shows various inclinations of tensile elements 4, and several tensile elements 4 that are attached to compression elements 7 essentially at the same point via a connection 6. An arrangement of prestressed tensile elements 4 is shown in FIG. 4 with a vertical plane of symmetry, and in FIG. 5 with a vertical and a horizontal plane of symmetry. The planes of symmetry are indicated by dash-dotted lines.

FIGS. 6-8 show various exemplary methods for solving the detail of the connection between membrane 9 and the prestressed tensile element 4. FIGS. 6 and 7 show variants in which this connection is realised non-positively in the axial direction of tensile element 4. In FIG. 6 the connection is created by bonding or welding, and in FIG. 7 via a connecting element 10 that connects prestressed tensile element 4 with compression/tension element 2 and at the same time non-positively seals the passthrough through membrane 9 in gas-impermeable manner. Connecting element 10 may be made for example from extruded PVC or metal.

FIG. 8 shows a variant having a gas-impermeable opening in membrane 9 that is movable along tensile element 4. An eyelet 11 is incorporated in membrane 9 and the point at which tensile element 4 passes through the membrane is sealed gas-tight manner via a seal 12.

The longitudinal section through a plate element 1 in the area of a prestressed tensile element 4 is shown in FIG. 9. This is the same variant for passing these tensile elements 4 through hollow body 3 as in FIGS. 1*a, b*. A channel 5 is incorporated in hollow body 3, and tensile element 4 is drawn through this.

FIG. 10 is a detailed view in longitudinal section of such a passthrough with channel 5. And endpiece 13 is furnished with an opening to accommodate a tensile element 4. Endpiece 13 may also be produced inexpensively from extruded PVC. It is also equipped with a device for clamping membrane 9 in gas-tight manner. It is also possible to bond endpiece 13 to membrane 9 by adhesion or welding. In this case, endpiece 13 does not need to include a membrane clamping device. A tube 14 placed over two endpieces 13 forms a channel 5, in which ambient pressure exists. Someone who is skilled in the art will be aware of other possible arrangements using an endpiece 13 and a membrane clamping device with an attached tube 19, for example a hose 14 slipped over the opening. The two endpieces 13 that are connected by a tube 19 or a hose 14 are or such size that they are able to be inserted into hollow body 3 through an aperture in membrane 9 and may be attached to membrane 9 from the inside.

FIGS. 11-13 show cross sections of various alternatives for arranging prestressed tensile elements 4. As shown in FIG. 11, it is also possible for more than one prestressed tensile element 4 to be passed through hollow body 3 side by side. Prestressed tensile elements 4 may also be used to connect compression/tension elements 2 outside hollow body 3 (FIG. 12, FIG. 13). If compression/tension elements 2 are flat, it is also conceivable and consistent with the invention to arrange several tubular hollow bodies 3 side by side between compression/tension elements 2 and in the direction of compression/tension elements 2 (FIG. 13).

Figure 14:
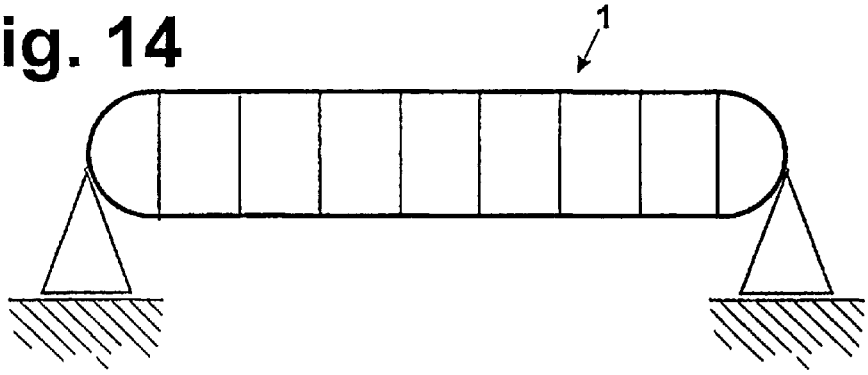
Figure 15:
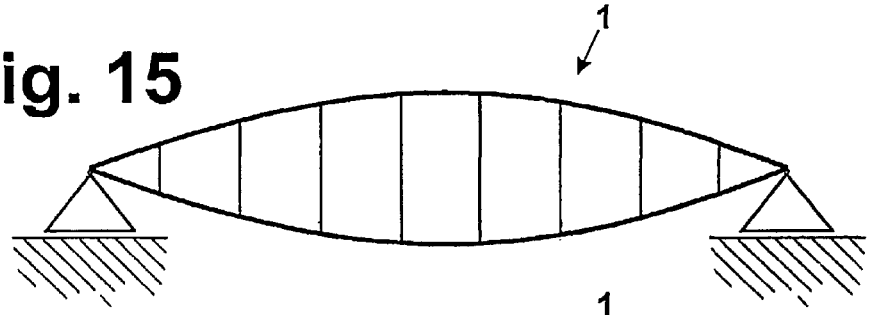
Figure 16:
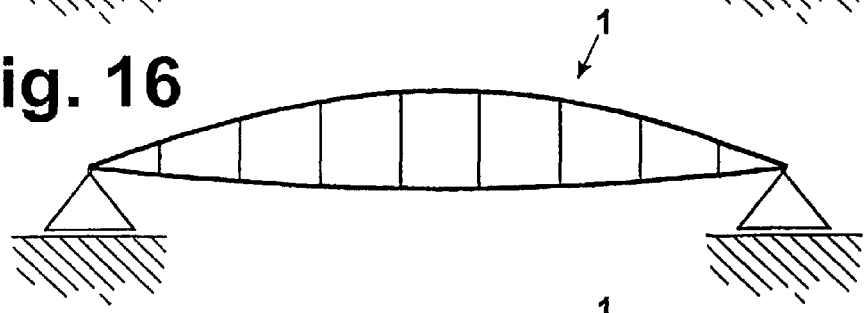

FIGS. 14-17 show several possible longitudinal section shapes for pneumatic plate elements 1, wherein only compression/tension elements 2 and tensile elements 4 are shown schematically. FIG. 14 shows an essentially rectangular longitudinal section, in which the two compression/tension elements 2 run parallel to each other for the most part. FIG. 15 shows a symmetrically lenticular longitudinal section, and FIG. 16 an asymmetrically lenticular longitudinal section. Arched longitudinal sections, as shown in FIG. 17, are also possible.

FIG. 18 shows an embodiment of a pneumatic plate element 1 in which the shape of hollow body 3 and the cavity defined by compression/tension elements 2 differ in the longitudinal section. Hollow body 3 may also occupy only a part of this cavity.

FIG. 19 shows a plate element 1 with multiple tubular hollow bodies 3 which, unlike the embodiment shown in FIG. 13, are arranged transversely to the direction of compression/tension elements 2.

The plate element 1 shown in FIG. 20 is divided into several segments in the direction of compression/tension elements 2. The segments are shown separated in longitudinal section. The individual segments are connected to form a complete compression/tension element 2 via non-positive, flexurally resistant connections with the aid of connecting members 20. The separability yields advantages in terms of transporting the elements. In general, it may be noted that all compression/tension elements 2 in the preceding and following examples may be constructed so as to be separable.

The following figures show a few possible embodiments of pneumatic plate elements 1 or combinations of plate elements 1. These examples reveal a further advantage compared to the related art, in that the carriers do not have to be essentially tubular, the disclosed construction method with prestressed vertical tensile elements 4 allows greater freedom of design and variation in shape. In particular, it enables two-dimensional, plate-shaped carriers to be produced.

FIG. 21 is a schematic, isometric representation of a pneumatic plate element 1 having compression/tension elements 2 extending parallel in one direction. The compression/tension elements 2 form pairs, in which one compression/tension element 2 extends over hollow body 3, and one compression/tension elements 2 extends below hollow body 3. The single hollow body creates the prestress for tensile elements 4 on three pairs of compression/tension elements 2. Only compression/tension elements 2 and hollow body 3, which is illustrated by additional lines, are shown in the schematic diagram. The prestressed tensile elements 4 extend between the paired compression/tension elements 2, but they are not shown in this or the following figures.

In FIG. 22, three pressure plates with a cross section that becomes narrower towards the middle are used as pressure elements 7. At their supported ends, the three pressure plates form an unbroken, full-length edge.

In FIG. 23, pressure elements 7 are also reinforced with transverse struts 15 and wind braces 16. And finally FIG. 24 shows yet another embodiment that includes a single, plate-shaped pressure element 7 with large cutouts. The cutouts may be provided in any size or shape, in any pattern, and in any number, and serve primarily to reduce weight. It is clearly shown in this embodiment that compression/tension elements 2 do not necessarily have to be paired. A single plate-shaped pressure element 7 may be connected at its ends with several tension elements 8 or compression/tension elements 2.

FIGS. 25-27 show embodiments of pneumatic plate elements 1 with compression/tension elements 2 that are arranged in two or more directions. In FIG. 25, four pairs of compression/tension elements 2 form a cross that is filled out by hollow body 3 to form an octagonal surface. In this case, compression/tension elements 2 are arranged orthogonally with each other.

FIG. 26 shows an example of a plate element 1 with a polygonal plan. The three pairs of compression/tension elements 2 are arranged in a star formation. The angles between the pairs of compression/tension elements 2 may be chosen at will. Also, compression/tension elements 2 may intersect at different and multiple points.

FIG. 27 shows a further embodiment of a plate element 1 with compression/tension elements 2, arranged in two directions. Three contiguous crosses, each formed from two pairs of compression/tension elements 2, and a hollow body 3 form a large, rectangular plate element 1. Each pressure element 7 must be supported on a support 17 at both ends. In the case of a roof, the function of support 17 may be served by columns, for example.

FIG. 28 shows in an aerial view how plate elements 1 with a hexagonal plan may be combined in any manner to form larger, contiguous surfaces.

Further options for combining plate elements 1 to form larger area structures based on rectangular area structures are shown in FIGS. 29, 30. FIG. 29 is an isometric diagram of an area consisting of six combined plate elements 1 with compression/tension elements 2 arranged in two directions. In FIG. 30, the same area is shown diagrammatically with the compression/tension elements 2 and formed by two plate elements 1 with compression/tension elements 2 arranged in four directions.

In the case of roofs, for example, the insulating property of plate element 1 may be increased substantially due to the reduction in convective heat transfer brought about by one or more membranes that are introduced horizontally in hollow body 3 and at all events positioned using textile crosspieces. For safety purposes, a large hollow body 3 may be divided into several chambers that are isolated in air-tight manner from each other, so that if the membrane is damaged pressure is not lost in the entire hollow body 3, and the failure only affects a part of the chambers. Because of the small pressures required, less than 100 mbar, hollow bodies 3 that extend more than 10 m may also be loaded with compressed air using a fan instead of a compressor.

In FIGS. 31*a, b* shows a further diagrammatic illustration of an embodiment of the basic inventive principle described in the preceding. Compression/tension elements 2 may be constructed as two-dimensional, polygonal lattices, which in turn consist of multiple element sections 21 joined via connectors 22 and form a pressure/tension lattice 23. Two such pressure/tension lattices 23 enclose one or more hollow bodies 3 and are connected via tensile elements 4. At the connections 22 where element sections 2 meet, the two pressure/tension lattices 23 are connected with at least one tensile element 4, unless element sections 21 from different pressure/tension lattices 23 meet directly, as happened for example at the edge of plate element 1 or in the case of connections 22 that rest on supports 17 inside the area of plate element 1. Additional tensile elements 4 may also be attached along the length of element sections 21. For example, instead of four continuous compression/tension elements 2 that are connected to each other, the plate element in FIG. 25 might also be constructed from twelve element sections 21 that form a pressure/tension lattice with four connections 22. Depending on the load type, connections 22 must be capable of absorbing and transferring compression and/or tension loads. Connection 22 may be constructed for example from an additional connecting element, with articulations, also from a rigid, non-separable connection for example by welding or adhesive bonding.

FIG. 31*a* shows an isometric diagram of plate element 1, wherein upper pressure/tension lattice 23 is shown separated from the lower lattice for clarity, hollow body 3 has been omitted entirely, and the course of tensile members 4 is indicated with dotted lines for exemplary purposes at just a few connections 22.

Figure 31B:
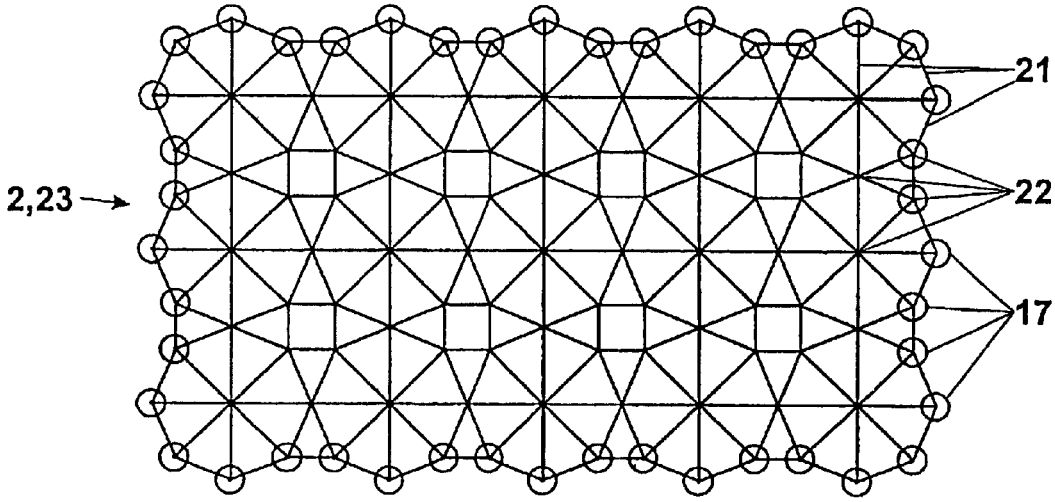

FIG. 31*b* shows a schematic plan view of the embodiment of FIG. 31*a*.

Another possible method for dividing a pressure/tension element into several element sections 21 is shown in FIG. 32. In FIG. 32, it is conceivable that besides the supports 17 at the edge of pressure/tension lattice 23, one or more additional supports 17 are present inside the area of plate element 1. If an additional support 17 is provided in the middle of pressure/tension lattice 23, hollow body 3 is annular, or essentially toroidal, and the upper and lower pressure/tension lattices 23 meet at support 17 or are connected via a vertical pressure element.

Pneumatic carrier structures may be constructed from multiple plate elements 1. A plate element 1 with pressure/tension lattices 23 may have practically any two-dimensional shape.

Particularly when several plate elements 1 are combined, the architect or engineer has an extremely high degree of design freedom.

The shape and size of the mesh in pressure/tension lattices 23 may be adapted to the actual progress of stress in plate element 1. Element sections 21 may be of various lengths, shapes and strengths, and may be constructed from various materials. For example, greater stresses may occur at the edge of plate element 1, close to supports 17, than towards the middle of the area of the pressure/tension lattice 23.

The pneumatic plate elements 1 according to the invention with pressure/tension lattices 23 are particularly suitable for loads that are distributed in two dimensions, such as occur particularly for example as a result of snow and wind loads on roof construction.

Of course, such plate elements 1 may also take many other forms, and these in turn may be combined in many different ways to form larger two-dimensional structures. On the basis of the fundamental principle illustrated in FIG. 1, compression/tension elements 2 may be distributed in any direction and number over the surface of the at least one hollow body 3, and even the one or more hollow bodies 3 may have any shape.

When plate elements 1 are used as floating, rigid containers, hollow bodies 3 may also be filled with a liquid, for example petrol or oil. These containers may be used as stationary tanks, or they are also highly suitable for towing by ships due to their rigidity.

On the other hand, if hollow bodies 3 are loaded with a gas that is lighter than air, the weight of the plate element 1 may be reduced so that the entire construction floats in the air and static buoyancy ensues.

The invention claimed is:

1. A pneumatic plate element comprising:

at least one hollow body made from a flexible material that is gas-tight and capable of sustaining loads from a pressure media under operating pressure;

at least two compression/tension elements surrounding the at least one hollow body, wherein each end of each compression/tension element of the at least two compression/tension elements is directly attached to an end of another compression/tension element of the at least two compression/tension elements;

wherein the at least one hollow body is located between the at least two compression/tension elements;

wherein at least two of the at least two compression/tension elements are connected to each other via at least one pure tensile element;

wherein the at least one pure tensile element is connected to each of the at least two compression/tensions elements at a point not corresponding to respective ends of the at least two compression/tension elements; and wherein, responsive to application of a load to the pneumatic plate element under operating pressure, a first compression/tension element of the at least two compression/tension elements is axially compressed and a second compression/tension element of the at least two compression/tension elements is axially tensioned.

2. The pneumatic plate element of claim 1, wherein a prestressing force in the at least one pure tensile element is greater than a stabilising force required to prevent buckling of the at least two compression/tension elements.

3. The pneumatic plate element of claim 2, wherein under operating pressure a first compression/tension element of the at least two compression/tension element elements is constructed as purely a compression element and a second compression/tension element of the at least two compression/tension elements is constructed as purely a tensile element under an operating load.

4. The pneumatic plate element of claim 1 wherein the at least one pure tension element passes through the at least one hollow body.

5. The pneumatic plate element of claim 1 wherein the at least one pure tensile element passes around an outside region of the at least one hollow body.

6. The pneumatic plate element of claim 1 wherein the at least one pure tensile element passes through the at least one hollow body without connection between a membrane and the at least one pure tensile element in a direction of the at least one pure tensile element.

7. The pneumatic plate element of claim 6, wherein:

the at least one pure tensile element is guided through an eyelet incorporated in the membrane;

the eyelet is sealed in a gas-tight manner via a seal arranged to be flush with the at least one pure tensile element; and the eyelet and the seal are axially displaceable on the at least one pure tensile element.

8. The pneumatic plate element of claim 1 wherein the at least one pure tensile element is disposed within a plurality of gas-tight channels in the at least one hollow body.

9. The pneumatic plate element of claim 8, wherein the plurality of gas-tight channels comprise:

two endpieces connected to each other by a tube that penetrates the at least one hollow body through a plurality of apertures in a membrane, and wherein the two endpieces can be attached to the membrane by at least one of clamping, bonding or welding.

10. The pneumatic plate element of claim 9, wherein the tube comprises a hose secured in a gas-tight manner to the two endpieces.

11. The pneumatic plate element of claim 1, comprising at least two hollow bodies arranged substantially parallel in a direction of the at least two compression/tension elements.

12. The pneumatic plate element of claim 1, comprising at least two hollow bodies arranged substantially parallel to each other transverse to a direction of the at least two compression/tension elements.

13. The pneumatic plate element of claim 1, wherein:

the pneumatic plate element is separable into at least two parts in a direction of the at least two compression/tension elements, and partial sections of the at least two compression/tension elements are connected to each other in a detachable, flexurally rigid manner via a plurality of connectors.

14. The pneumatic plate element of claim 1, comprising at least two pairs of compression/tension elements that are arranged parallel to each another and are connected to each other at respective ends.

15. The pneumatic plate element of claim 1, comprising a plurality of plate-shaped compression/tension elements, the plurality of plate-shaped compression/tension elements comprising cross sections which vary over a length of the plurality of plate-shaped compression/tension elements.

16. The pneumatic plate element of claim 1, comprising a plurality of cross-members extending essentially transversely between the at least two compression/tension elements.

17. The pneumatic plate element of claim 1, wherein at least one of the at least two compression/tension elements is constructed as a panel with a plurality of cutouts.

18. The pneumatic plate element of claim 1, wherein the at least two compression/tension elements attached to each other at the respective ends are arranged to form a polygon.

19. The pneumatic plate element of claim 1, wherein at least one horizontal intermediate membrane is drawn inside the at least one hollow body, the at least one horizontal intermediate membrane is operable to increase an insulating property of the at least one hollow body and reduce a vertical transport of heat by convection.

20. The pneumatic plate element of claim 1, wherein the at least two compression/tension elements are constructed as a plurality of two-dimensional, polygonal compression/tension lattices, such compression/tension lattices comprising a plurality of element sections joined by a plurality of connections.

21. The pneumatic plate element of claim 20, wherein at least two of the plurality of compression/tension lattices are connected via the at least one pure tensile element at least at all of the connections.

22. The pneumatic plate element of claim 20, wherein the plurality of two-dimensional, polygonal element sections and the connections are integrated in a membrane of the at least one hollow body.

23. The pneumatic plate element of claim 22, wherein the plurality of element sections are made from a plurality of fibre-reinforced, flexible plastic strips.

24. The pneumatic plate element of claim 22, wherein the pneumatic plate element is constructed to allow folding or rolling in one piece together with a membrane of the at least one hollow body and the plurality of element sections.

25. The pneumatic plate element of claim 20, wherein the plurality of element sections that are subjected to tensile stresses are constructed as purely tensile elements.

26. The pneumatic plate element of claim 1, wherein the at least one hollow body is divided by a plurality of gas-tight partition walls into a plurality of chambers that are pressurized independently of one another.

27. The pneumatic plate element of claim 20, wherein the plurality of two-dimensional, polygonal compression/tension lattices are constructed from a plurality of element sections of differing shapes and strengths.

28. The pneumatic plate element of claim 1, wherein a plurality of pneumatic plate elements are joined to form essentially two-dimensional or three-dimensional structures.

29. The pneumatic plate element of claim 1, wherein a plurality of pneumatic plate elements are utilized in combination to form larger, connected two-dimensional structures.

30. The pneumatic plate element of claim 1, wherein the pneumatic plate element is utilized as a roof.

31. The pneumatic plate element of claim 1, wherein the pneumatic plate element is utilized as a bridge.

32. The pneumatic plate element of claim 1, wherein the pneumatic plate element is utilized as a floating rigid container.

33. The pneumatic plate element of claim 1, wherein the at least one hollow body is filled with a liquid and used as a floating, rigid container for transport or storage.

34. The pneumatic plate element of claim 1, wherein the at least one hollow body is loaded with a gas that is lighter than air and used as a floating or semi-floating roof.

35. The pneumatic plate element of claim 1, wherein the at least one pure tensile element is pre-stressed via the at least one hollow body under pressure loading.

36. The pneumatic plate element of claim 1, comprising a plurality of wind braces extending essentially diagonally between the at least two compression/tension elements.

37. The pneumatic plate element of claim 1 wherein the direct attachment between the at least two compression/tension elements comprises a connecting element.

38. The pneumatic plate element of claim 1 wherein the direct attachment between the at least two compression/tension elements comprises an articulation.

* * * * *